United States Patent [19]

Fouke

[11] Patent Number: 4,858,091

[45] Date of Patent: Aug. 15, 1989

[54] LUMINAIRE WITH UPLIGHT CONTROL

[75] Inventor: Herbert A. Fouke, Newark, Ohio

[73] Assignee: Manville Corporation, Denver, Colo.

[21] Appl. No.: 127,339

[22] Filed: Dec. 1, 1987

[51] Int. Cl.[4] ..... F21V 5/02

[52] U.S. Cl. ..... 362/332; 362/337; 362/340

[58] Field of Search ..... 362/326, 332, 339, 340, 362/337

[56] References Cited

U.S. PATENT DOCUMENTS

| | | | |
|---|---|---|---|
| 1,699,100 | 1/1929 | Dorey | 362/332 |
| 2,133,378 | 10/1938 | Culloman | 362/326 X |
| 3,191,022 | 6/1965 | Wince | 362/332 X |
| 3,275,825 | 9/1966 | Wilty | 362/332 |
| 3,679,891 | 7/1972 | Quack | 362/326 X |
| 4,384,316 | 5/1983 | de Vos et al. | 362/339 X |

*Primary Examiner*—Ira S. Lazarus
*Assistant Examiner*—Peggy Neils
*Attorney, Agent, or Firm*—John D. Lister; Cornelius P. Quinn

[57] ABSTRACT

An improved luminaire having uplight control to provide uniform ceiling illumination and downward light control below horizontal to uniformly distribute downward light with the added feature of eliminating glare between the 60°-90° vertical.

3 Claims, 6 Drawing Sheets

LUMINAIRE WITH UPLIGHT CONTROL

The present invention relates to a improved luminaire with uplight control and more particularly to a luminaire with an HID light source having uplight control and low glare.

BACKGROUND OF THE INVENTION

Certain types of industries, commonly referred to as "light industrial" and certain commercial areas such as supermarkets etc. can advantageously employ luminaires with a relatively large amount of upward light, that is light emitted above horizontal or just below horizontal. Such areas generally have either finished ceilings or a truss area painted a light color. Thus a large percentage of the uplight is reflected down to the work surface.

Providing a higher percentage of uplight in these types of areas produces several advantages such as:

(a) superior appearance of the environment due to greater illumination on ceiling and vertical surfaces;

(b) reflected light from ceilings and walls results in more light from more directions reaching a work area; and (c) better vertical surface lighting.

Prior to the present invention luminaires using HID light sources to produce large percentages of uplight do so by utilizing leakage light through prismatic glass reflectors. Thus, the uplight has been generally uncontrolled and the illumination on the ceiling is not uniform and usually has a very hot spot directly above the luminaire.

The present invention utilizes a refracting medium of glass or plastic with prismatic structures such that the upward light is controlled to produce a uniformly lit ceiling area.

SUMMARY OF THE INVENTION

Accordingly, the present invention provides a luminaire comprising an HID light source, a first refractor means for providing uniform uplight illumination through distribution of light rays and a second refractor means for distributing light rays below horizontal.

FIG. I illustrates a luminaire in accordance with the present invention.

FIG. II illustrates the distribution of upward light from two luminaires in accordance with the present invention.

FIG. III illustrates a typical candlepower distribution curve for a luminaire of FIG. I.

FIG. IV shows a variation in accordance with the present invention of the luminaire illustrated in FIG. I.

FIG. V illustrates a typical candlepower distribution curve for a luminaire as shown in FIG. IV.

FIG. VI is a cross-section view taken through A—A in FIG. I.

FIG. VII is a large scale view of the diffusing prisms shown in FIGS. I, IV and VI.

DESCRIPTION OF THE INVENTION

Figure 1:
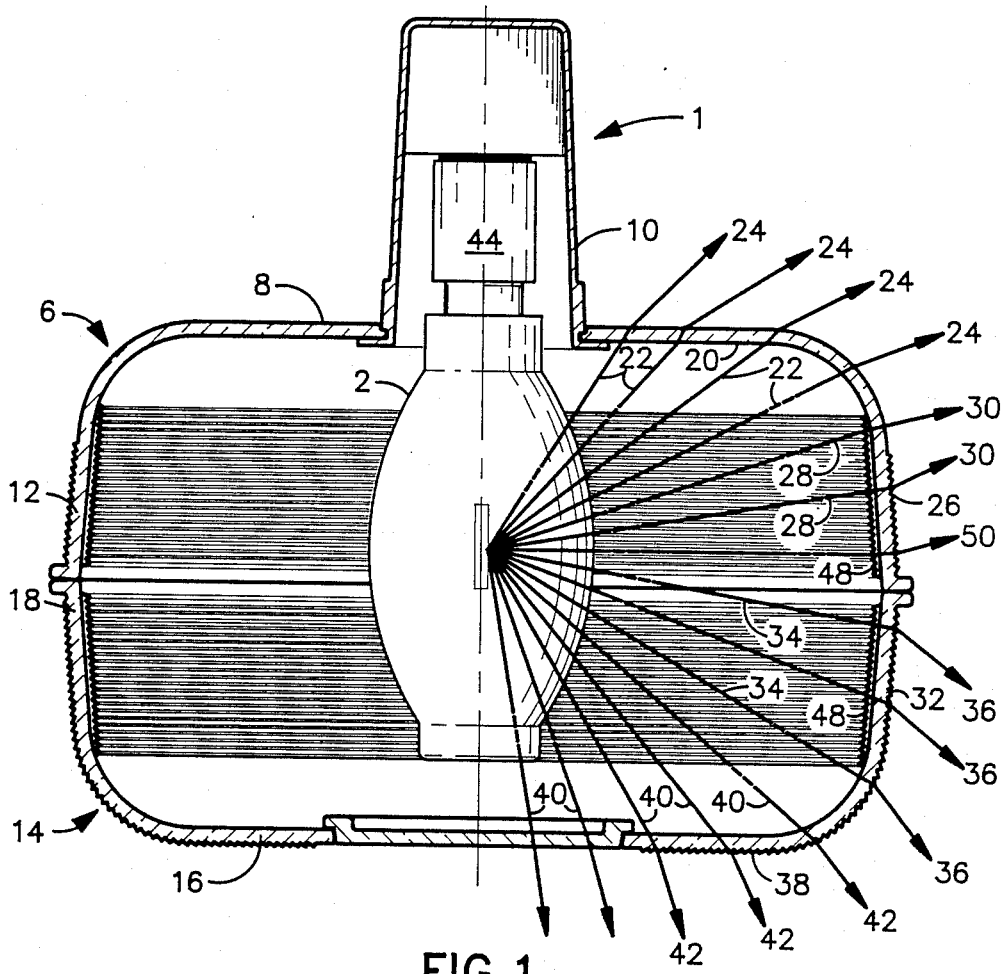
FIG. 1A shows a candlepower distribution curve for luminaires of the type discussed of the prior art.
Figure 2:
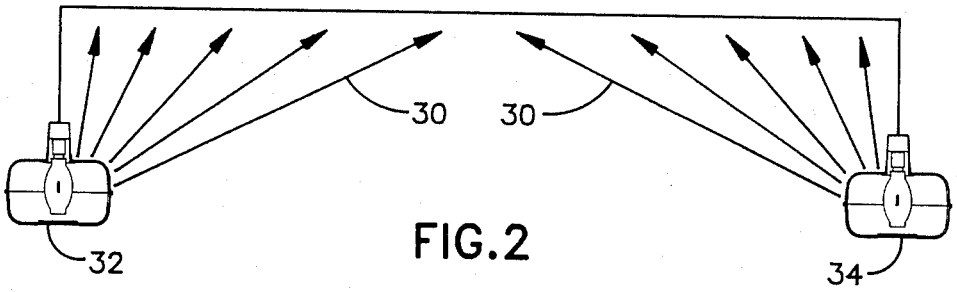
Figure 1A:
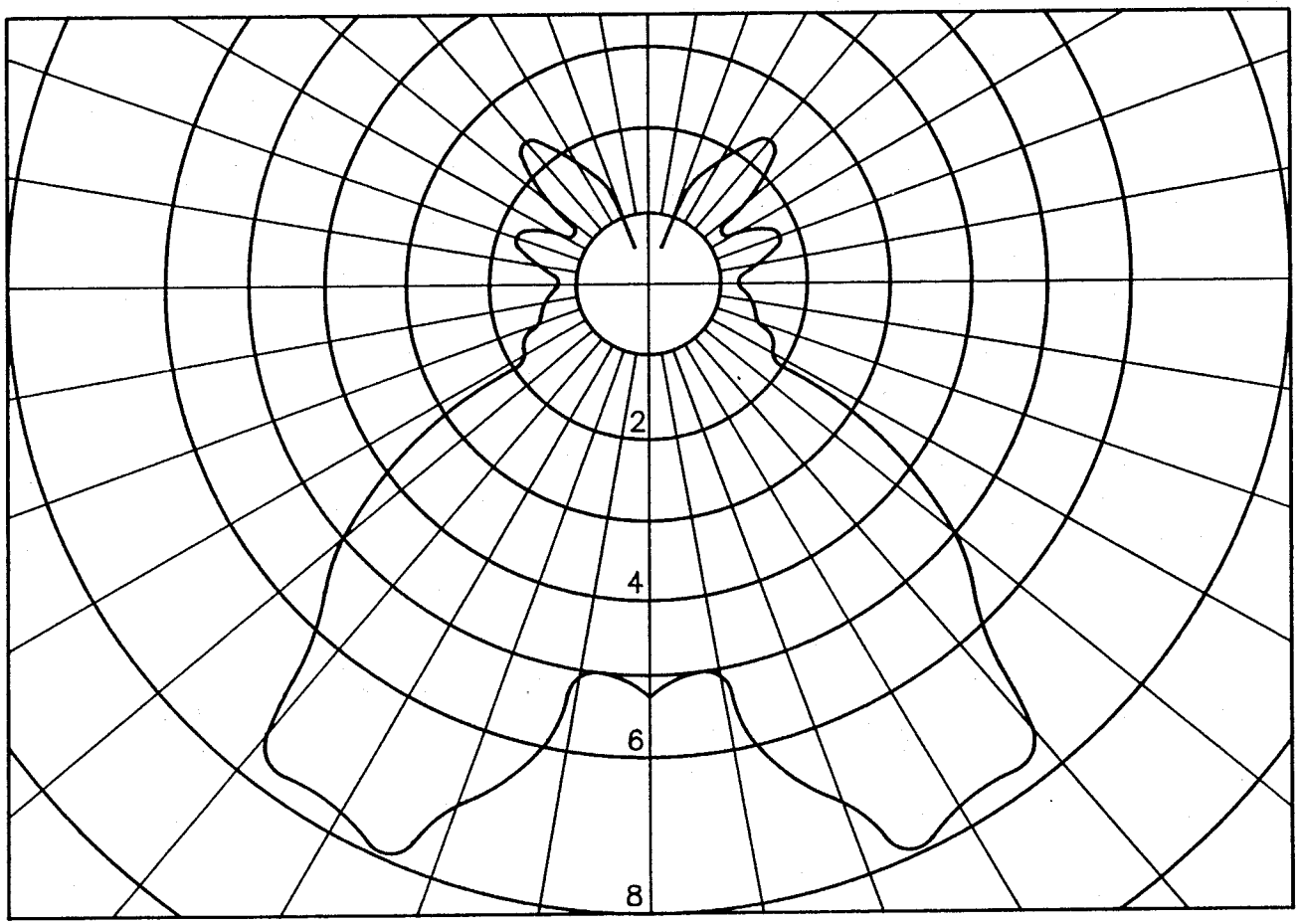
Figure 3:
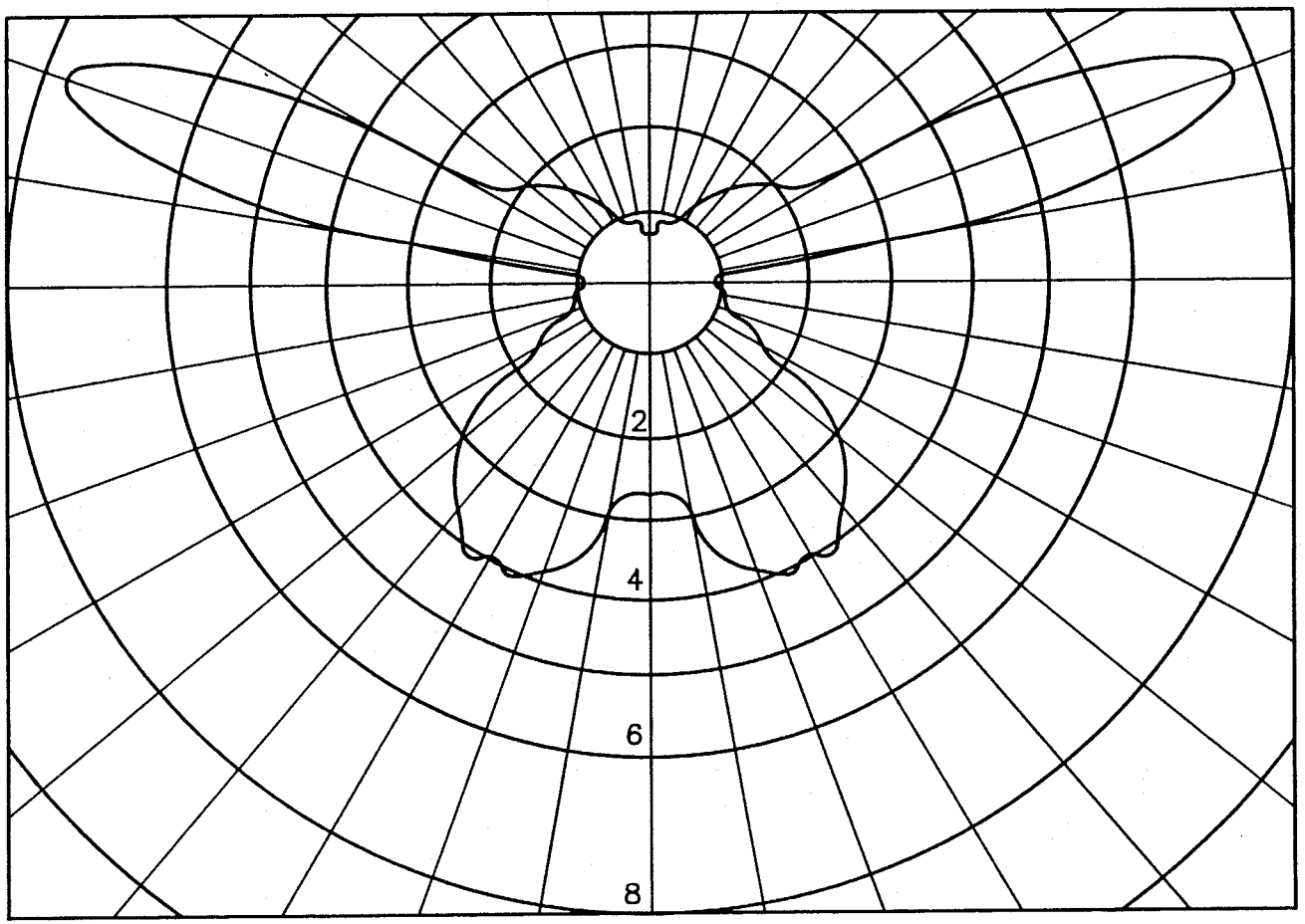
Figure 4:
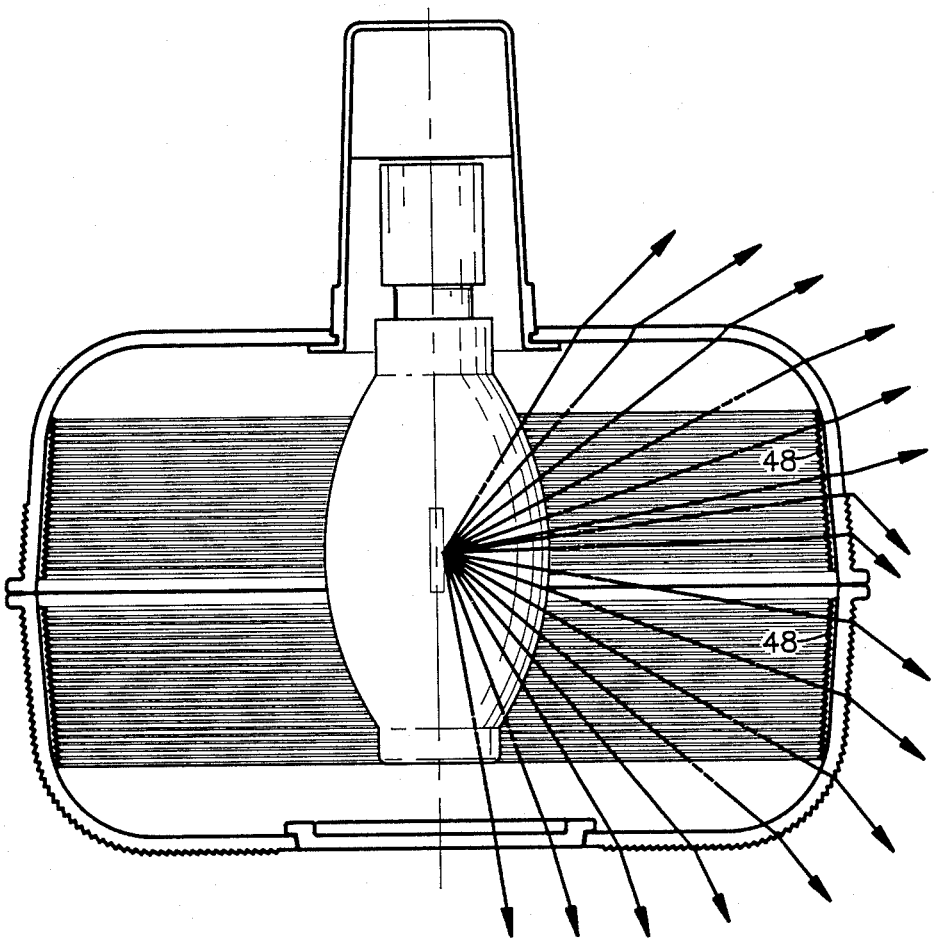
Figure 5:
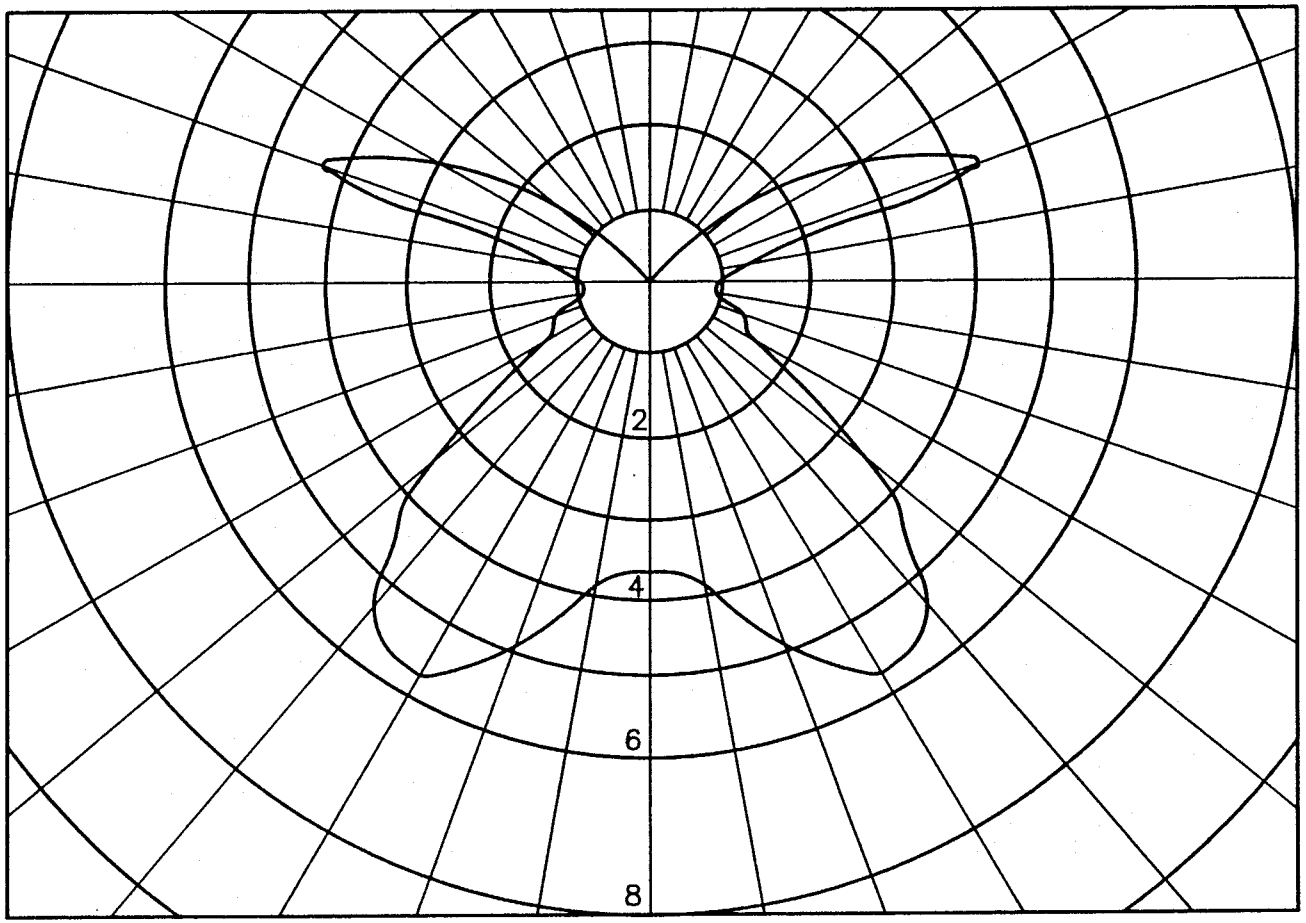
Figure 6:
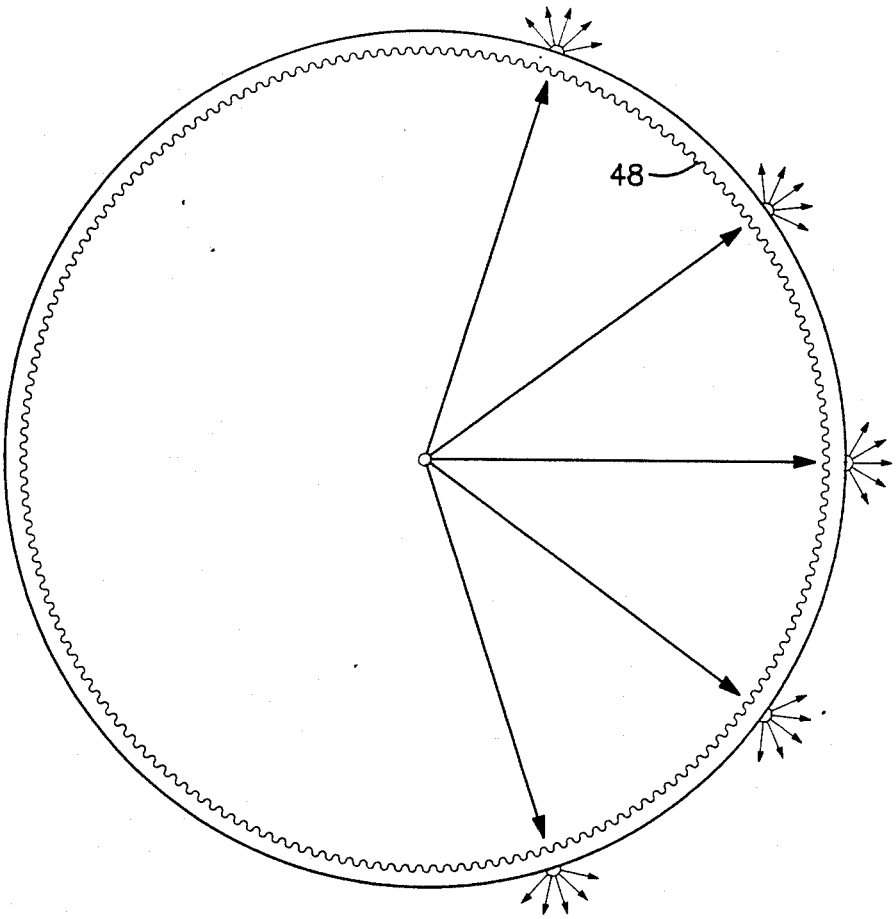
Figure 7:
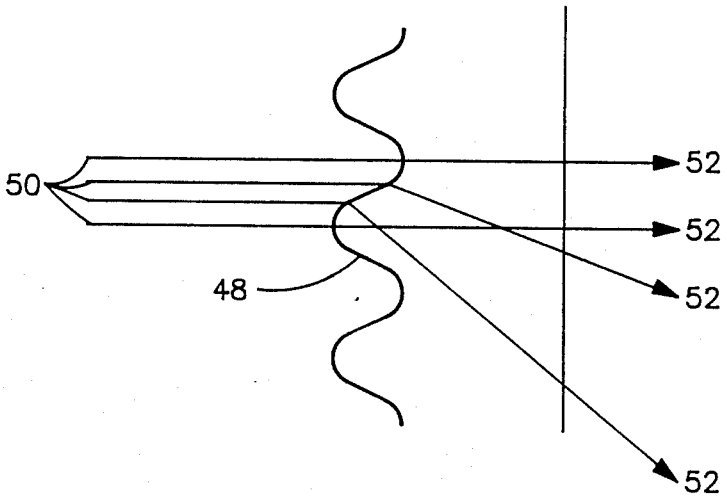

Referring to FIG. 1A there is shown a candlepower distribution curve for the prior art type luminaires in which luminaires using HID sources producing large percentages of uplight do so by utilizing the leakage light through prismatic glass reflectors.

In the present invention as shown in FIG. 1 a luminaire generally identified by the reference numeral 1 has an HID light source 2 engaged in an electrical socket 4 and is provided with an upper glass or plastic refractor generally identified by the reference numeral 6 having a sidewall 12 and a generally horizontal portion 8 encircling a luminaire hanger 10. It also includes a lower glass or plastic refractor generally identified by the reference numeral 14 having a generally horizontal portion 16 and a sidewall 18.

A plurality of prisms 20 are formed on the inside of the generally horizontal portion 8 of the upper refractor.

Light rays 22 emitted from the light source 2 strike the refractor 6 and are diverted by the prisms 20 so that the exiting light rays 24 are turned away from directly above the luminaire 1 thus reducing the brightness above the luminaire.

A plurality of prisms 26 are formed on the outside of the sidewall 12 of the upper refractor 6. Light rays 28 from the light source 2 strike the upper refractor 6 and are diverted by the prisms 26 so that exiting light rays 30 are elevated above horizontal and sent to a ceiling area at a point half way between two widely spaced luminaires 32 and 34, as shown in FIG. II thus increasing the illumination of the ceiling. The luminaires 32 and 34 for example, are normally spaced up to 1.7 times their mounting height.

The effect of the upper refractor 6 is that a uniformity of illumination on the ceiling is achieved which is much greater than if the same amount of light had been sent toward the ceiling without being redirected by the refractor 6.

A plurality of prisms 32 are formed on the outer surface of the sidewall 18 of the refractor 14. Light rays 34 from the light source 2 are diverted by the prisms 32 so that existing light rays 36 are directed down below horizontal by an angle greater than 30°.

A plurality of prisms 38 are formed on the outer surface of the substantially horizontal portion 16 of the refractor 14. Light rays 40 are diverted by the prisms 38 at varying degrees below horizontal to exit as light rays 42 at angles greater than light rays 32 thus concentrating the light emitted below horizontal into a relatively concentrated distribution which allows spacing these luminaires up to 1.7 times their mounting height.

A typical candlepower distribution curve for the luminaire described above and illustrated in FIG. I is shown in FIG. III.

As illustrated in FIG. III the distribution of this luminaire has approximately 40% of the light emitted by the luminaire in the 0°-90° zone (below horizontal) and 60% of the light in the 90°-180° zone (above horizontal).

By modifying some of the prisms 26 in the luminaire illustrated in FIG. I to turn the light rays 28 down instead of up toward the ceiling, a greater percentage of light from the luminaire can be sent in the 0°-90° zone. This luminaire shown in FIG. IV would have 60% of its light in the 0°-90° zone and 40% in the 90°-180° zone as illustrated in the candlepower distribution curve shown in FIG. V.

As is evident from FIG. IV by varying the width of the section sending light below horizontal these percentages can be varied.

In addition to the refractors 6 and 14 turning light above and below horizontal out of the glare zone from 60°–90° vertical the refractors have formed on the inner surfaces of their sidewall portions vertical diffusing prisms 48 as shown in FIGS. I, IV and VI.

FIG. VI is a cross-section view taken through A—A in FIG. I.

FIG. VII is an enlarged view of the vertical diffusing prisms 48.

The vertical diffusing prisms 48 have curved surfaces such that light rays 50 are diverted laterally at varying angles to be emitted as light rays 52. These light rays are spread laterally through a range of about ±62°. The entire width of the sidewalls of refractors 6 and 14 appear to be evenly bright thus reducing the average brightness of the sidewalls.

Whereas the foregoing detailed description has been provided for clearness of understanding, it should be understood that other and further modifications, apart from those disclosed or suggested herein, may be made within the spirit and scope of the invention.

I claim:

1. A luminaire comprising an HID light source, a first refractor having a substantially horizontal portion and a sidewall, prisms formed on the inner surface of said horizontal portion of said first refractor for the upward distribution of light rays, prisms formed on the outer surface of said sidewall of said first refractor for directing light rays upward from the horizontal, and prisms formed on the exterior of the sidewall of said first refractor for directing light rays below horizontal by an angle greater than 30° and a second refractor having a substantially horizontal portion and a sidewall, prisms formed on the exterior surface of said horizontal portion of said second refractor for directing light downward and prisms formed on the sidewall of said second refractor for directing light rays below horizontal by an angle greater than 30°.

2. A luminaire comprising an HID light source, a first refractor having a substantially horizontal portion and a sidewall, prisms formed on the inner surface of said horizontal portion of said first refractor for the upward distribution of light rays, prisms formed on the outer surface of said sidewall of said first refractor for directing light rays upward from the horizontal, a second refractor having a substantially horizontal portion and a sidewall, prisms formed on the exterior surface of said horizontal portion of said second refractor for directing light downward and prisms formed on the sidewall of said second refractor for directing light rays below horizontal by an angle greater than 30° and including vertical diffusing prisms formed on the inner surface of the sidewall of said first refractor and the sidewall of said second refractor to eliminate glare.

3. A luminaire as recited in claim 1 wherein vertical diffusing prisms are formed on the inner surfaces of the sidewall of said first refractor and the sidewall of said second refractor to eliminate glare.

* * * * *